US009741513B2

(12) United States Patent
Schmitz et al.

(10) Patent No.: US 9,741,513 B2
(45) Date of Patent: Aug. 22, 2017

(54) DOUBLE-CONTACT SWITCH WITH VACUUM SWITCHING CHAMBERS

(71) Applicant: EATON ELECTRICAL IP GMBH & CO. KG, Schoenefeld (DE)

(72) Inventors: Gerd Schmitz, Niederkassel (DE); Marcel Uedelhoven, Blankenheim (DE); Johannes Meissner, Bonn (DE); Michael Wohlang, Bornheim (DE)

(73) Assignee: EATON ELECTRICAL IP GMBH & CO. KG, Schoenefeld (DE)

( * ) Notice: Subject to any disclaimer, the term of this patent is extended or adjusted under 35 U.S.C. 154(b) by 0 days.

(21) Appl. No.: 15/104,993

(22) PCT Filed: Dec. 9, 2014

(86) PCT No.: PCT/EP2014/077006
§ 371 (c)(1),
(2) Date: Jun. 16, 2016

(87) PCT Pub. No.: WO2015/091096
PCT Pub. Date: Jun. 25, 2015

(65) Prior Publication Data

US 2016/0322185 A1 Nov. 3, 2016

(30) Foreign Application Priority Data

Dec. 17, 2013 (DE) ..... 10 2013 114 260

(51) Int. Cl.
*H01H 33/662* (2006.01)
*H01H 33/664* (2006.01)
(Continued)

(52) U.S. Cl.
CPC ..... *H01H 33/66207* (2013.01); *H01H 9/542* (2013.01); *H01H 33/664* (2013.01);
(Continued)

(58) Field of Classification Search
CPC ..... H01H 33/66207; H01H 33/66238; H01H 33/664; H01H 33/6647; H01H 33/66;
(Continued)

(56) References Cited

U.S. PATENT DOCUMENTS 3,405,245 A * 10/1968 Ito ..... H01H 33/6647 218/126
3,636,292 A 1/1972 Roth
(Continued)

FOREIGN PATENT DOCUMENTS

CN 103119679 A 5/2013
DE 1224806 B 9/1966
(Continued)

OTHER PUBLICATIONS

International Search Report of PCT/EP2014/077006, Feb. 4, 2015, pp. 1-2.

*Primary Examiner* — Renee Luebke
*Assistant Examiner* — William Bolton
(74) *Attorney, Agent, or Firm* — Leydig, Voit & Mayer, Ltd.

(57) ABSTRACT

A double-contact switch has first and second tubular vacuum switching chambers; a stationary electrode, between the first and second vacuum switching chamber, having a first stationary contact protruding into the first chamber and a second stationary contact protruding into the second chamber; a first electrode, arranged in the first chamber, moveable axially therein, having a contact support region and sealed off from the first chamber exterior; a second electrode, arranged in the second chamber, moveable axially therein, having a contact support region and scaled off from the second chamber exterior; a first contact compression spring applying a first spring force to the first movable electrode so the first electrode contact presses onto the contact protruding into the first chamber; and a second contact compression
(Continued)

spring applying a greater, second spring force to the second movable electrode so the second electrode contact presses onto the contact protruding into the second chamber.

14 Claims, 4 Drawing Sheets

(51) Int. Cl.
*H01H 33/666* (2006.01)
*H01H 9/54* (2006.01)
*H01H 33/14* (2006.01)
*H01H 89/00* (2006.01)

(52) U.S. Cl.
CPC ..... *H01H 33/666* (2013.01); *H01H 33/6647* (2013.01); *H01H 33/66238* (2013.01); *H01H 89/00* (2013.01); *H01H 33/14* (2013.01); *H01H 2033/66215* (2013.01); *H01H 2033/66223* (2013.01); *H01H 2235/01* (2013.01)

(58) Field of Classification Search
CPC ..... H01H 9/542; H01H 89/00; H01H 9/0038; H01H 33/14; H01H 2033/66215; H01H 2033/66223; H01H 2235/01
USPC ..... 218/139, 3–7, 10, 118
See application file for complete search history.

(56) References Cited

U.S. PATENT DOCUMENTS

| | | | | |
|---|---|---|---|---|
| 6,476,338 | B2 * | 11/2002 | Shioiri | H01H 33/66261 218/118 |
| 8,471,166 | B1 | 6/2013 | Glaser | |
| 2003/0193770 | A1 | 10/2003 | Chung | |
| 2013/0220782 | A1 * | 8/2013 | Dohnal | H01F 29/04 200/16 R |

FOREIGN PATENT DOCUMENTS

| | | | |
|---|---|---|---|
| DE | 3318226 | A1 | 11/1984 |
| DE | 3811833 | A1 | 10/1989 |
| DE | 19902498 | A1 | 9/2000 |
| DE | 10157140 | A1 | 5/2003 |
| DE | 10315982 | A1 | 11/2003 |
| EP | 1881510 | A1 | 1/2008 |
| GB | 1206297 | A | 9/1970 |
| JP | S 4930856 | U | 3/1974 |

* cited by examiner

DOUBLE-CONTACT SWITCH WITH VACUUM SWITCHING CHAMBERS

CROSS-REFERENCE TO RELATED APPLICATIONS

This application is a U.S. national stage application under 35 U.S.C. §371 of International Application No. PCT/EP2014/077006, filed on Dec. 9, 2014, and claims benefit to German Patent Application No. DE 10 2013 114 260.5, filed on Dec. 17, 2013. The International Application was published in German on Jun. 25, 2015, as WO 2015/091096 A1 under PCT Article 21(2).

FIELD

The invention relates to a double-contact switch comprising vacuum switching chambers and to a hybrid switching device comprising a double-contact switch of this type.

BACKGROUND

The conventional switching principle for switching on and off high currents in switching devices generally involves a double-interrupt contact arrangement, which guides the switch arcs occurring therein via arc guide rails in a stack arrangement of baffles in the form of deionizing chambers. In these chambers, the arcs are cooled and divided into a plurality of sub-arcs, this being linked to a corresponding multiplication of the arc voltage. When the driving voltage is achieved, the arc is quenched and the circuit is thus interrupted. When high alternating currents are switched, the arc quenching is generally assisted by dynamic magnetic blow fields, which are formed by suitably shaping the current conductors within the switching device. By contrast, for quenching direct currents, magnetic blow fields are generally used, which are generally produced by an arrangement of permanent magnets.

Unlike in the conventional AC switching devices which have long been on the market, comparably large switching devices for disconnecting low-frequency currents, for example at 16⅔ Hz, and direct currents are subject to correspondingly higher loads as a result of the reduced or absent periodicity of the current zero crossing. The resulting longer arc duration results in a higher energy content of the switch arcs than in AC switching devices. This leads to an increased burnup of contact material, and also to a correspondingly high thermal load within the switching chamber. A thermal load of this type can reduce the insulation capacity within a switching chamber. As a result, the electrical service life of the switching device may be reduced.

One option for reducing the load on a switching device from switch arcs is provided by hybrid switches, which consist of a parallel connection of an electromechanically actuated mechanical contact arrangement and a power semiconductor switch for example on the basis of a high-power IGBT (insulated gate bipolar transistor), as disclosed for example in German laid-open publication DE 10315982 A1. This has a high resistance when switched on, in such a way that the load current flows exclusively via the closed mechanical contacts. During the switch-off process, the power semiconductor is controlled in such a way that it briefly has a low resistance, in such a way that the arc current flowing through the mechanical switch is briefly commuted to the parallel power semiconductor switch; subsequently, this is controlled to block current again, causing the current commuted to the semiconductor to be rapidly brought to zero therein in an arc-free manner. Using a hybrid arrangement of this type, the effective arc time and thus the load on the switch can be greatly reduced.

To achieve a high electrical service life and acceptable dimensioning of the power semiconductor switch for high currents, it is expedient to limit the current flow time during the switch-off process. In air-operated switching arrangements, especially for high currents, this has the drawback that during the switching process using a typical mechanical bridge switching arrangement temporal fluctuations occur at an order of magnitude such that fully arc-free switching with only a brief current load on the power semiconductor switch can only be implemented with difficulty in practice.

This drawback can be overcome by using a vacuum switching chamber. Unlike with air switching, where the air in the region of the switch arc is ionized in part during the switching process, in a vacuum switching chamber a metal vapor arc of evaporating contact material is formed in a vacuum switching chamber when the contacts are disconnected under load, and condenses out in the interior of the vacuum chamber within a few microseconds in the zero-current case, resulting in virtually instantaneous reconsolidation of the switching path in the absence of an ionizable gaseous atmosphere.

Vacuum switching chambers, as disclosed for example in German laid-open publication DE 19902498 A1, usually consist of a connection electrode rigidly connected to the switching chamber housing and comprising a fixed contact at the inner end thereof and an opposite electrode comprising a sliding contact which is movable over a flexible metal bellows in an axial direction with respect to the fixed electrode in a vacuum-tight manner. Double-contact switches comprising vacuum switching chambers are known for example from German laid-open publications DE 38 11 833 A1 and DE 101 57 140 A1 and from US patent specification U.S. Pat. No. 8,471,166 B1.

SUMMARY

An aspect of the invention provides a double-contact switch, comprising: a first and a second tubular vacuum switching chamber, each formed as switching sub-chambers of a switching tube; an additional electrode, stationary in the switching tube, arranged between the first and second vacuum switching chambers and including a first fixed contact projecting into the first vacuum switching chamber and a second fixed contact projecting into the second vacuum switching chamber; a first movable electrode, arranged in the first vacuum switching chamber, the first movable electrode being movable in an axial direction in the first vacuum switching chamber, and the first movable electrode including a first region which supports a first electrode contact, the first region being sealed off from outside of the first vacuum switching chamber in a gas-tight manner; a second movable electrode arranged in the second vacuum switching chamber, the second movable electrode being movable in an axial direction in the second vacuum switching chamber, and the second movable electrode including a second region which supports a second electrode contact, the second region being sealed off from outside of the second vacuum switching chamber in a gas-tight manner; a first contact compression spring configured to apply a first spring force to the first movable electrode such that the first electrode contact is pressed onto the first fixed contact; and a second contact compression spring configured to apply a second spring force to the second movable electrode such that the second electrode contact is pressed onto the second fixed contact, wherein the first spring force is less than the second spring force; wherein switching tube is movably mounted in a housing of a double-contact switch, and wherein the first movable electrode is rigidly connected to the housing of the double-contact switch.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
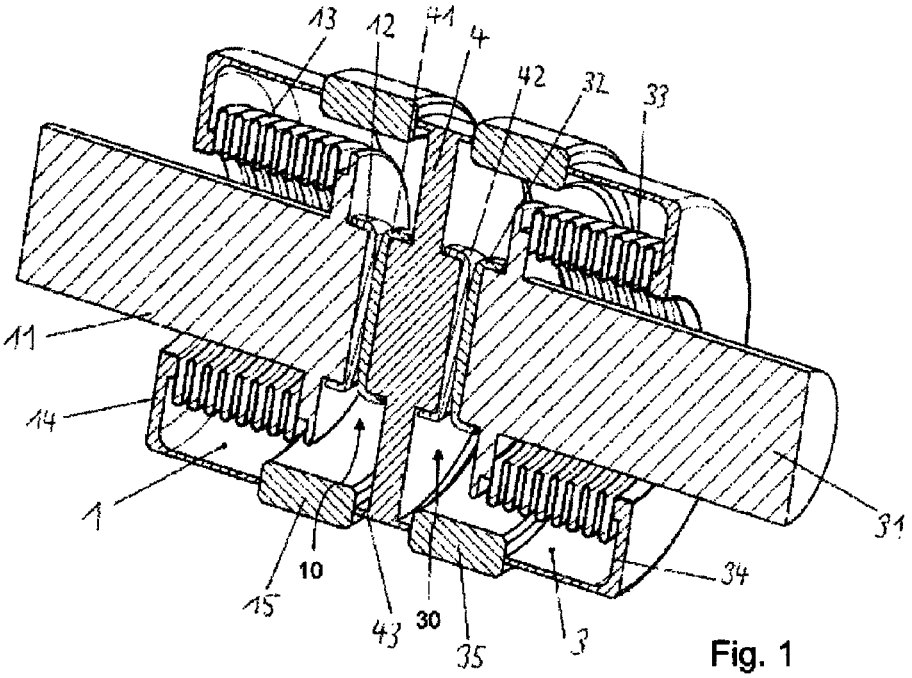
FIG. 1 is a perspective view of a sectional drawing of an embodiment of a double-contact switch comprising vacuum switching chambers according to the invention.

An aspect of the present invention provides a double-contact switch comprising vacuum switching chambers which is suitable in particular for use in a hybrid switch, in other words a switch comprising a parallel connection of an electromechanically actuated mechanical contact arrangement and a power semiconductor switch.

The concept underlying an aspect of the invention is to provide a double-contact switch comprising vacuum switching chambers which is formed in such a way that when a load current flowing through the switch is switched off the two contact pairs are opened with a mutual temporal offset. According to the invention, this is achieved in that two movable electrodes of the switch are each pressed onto fixed contacts in the vacuum switching chambers using contact compression springs having different spring forces. When the contacts are opened, a first contact pair is opened temporally before a second contact pair as a result of the different spring forces. As a result, the double-contact switch according to the invention is suitable in particular for use in a hybrid switch in which a power semiconductor switch is switched in parallel with the first contact pair which opens temporally first. When the first contact pair is opened, by connecting through the power semiconductor switch, an arc can be prevented from forming between the contact pair which opens temporally first. By blocking the power semiconductor switch during the opening of the first contact pair, the load current commuted to the power semiconductor switch can be brought to zero, in particular before the second contact pair is opened. As a result, the load current can be switched off virtually without arc formation.

One embodiment of the invention relates to a double-contact switch comprising a first and a second tubular vacuum switching chamber, a stationary electrode arranged between the first and second vacuum switching chambers and comprising a first fixed contact projecting into the first vacuum switching chamber and a second fixed contact projecting into the second vacuum switching chamber, a first electrode arranged in the first vacuum switching chamber and movable therein in the axial direction and comprising a region which supports a contact and is sealed off from the outside of the first vacuum switching chamber in a gas-tight manner, a second electrode arranged in the second vacuum switching chamber and movable therein in the axial direction and comprising a region which supports a contact and is sealed off from the outside of the second vacuum switching chamber in a gas-tight manner, a first contact compression spring for applying a first spring force to the first movable electrode in such a way that the contact of the first electrode is pressed onto the fixed contact projecting into the first vacuum switching chamber, a second contact compression spring for applying a second spring force to the second movable electrode in such a way that the contact of the second electrode is pressed onto the fixed contact projecting into the second vacuum switching chamber, wherein the first spring force is less than the second spring force.

The vacuum switching chambers may be in the form of switching sub-chambers of a switching tube of in particular rotationally symmetrical, cylindrical configuration, the switching sub-chambers in particular being formed so as to be similar or identical. A switching tube of this type has the advantage that the vacuum switching chambers can be implemented at a relatively low technical complexity.

The switching tube may comprise, approximately in the center thereof, a partition wall of a conductive material for separating the two vacuum switching chambers which supports the first fixed contact and the second fixed contact on each of the two sides thereof in such a way that the end faces of the fixed contacts face the interior of the associated vacuum switching chamber and the region of the movable first or second electrode supporting the contact.

Alternatively, the switching tube may comprise, approximately in the center thereof, a partition wall for separating the two vacuum switching chambers which is formed in such a way that it acts as a double contact arrangement and the contact face thereof consists of an electrically conductive and welding-resistant material.

The regions of the first and second electrode which support contacts may each be sealed off in a gas-tight manner by means of a flexible metal bellows.

The switching tube may be provided with a cover at each of the two ends thereof, and each metal bellows may be soldered at the end faces to one of the covers and also to one of the movable electrodes, respectively, in each case via a peripheral vacuum-tight solder connection.

The vacuum switching chambers may be formed as chambers separated in a gas-tight manner or be partially interconnected in such a way that they have a shared vacuum.

For electrical insulation from the movable first and second electrodes, the stationary electrode may be connected at the peripheral end faces thereof to the associated vacuum switching chamber in a vacuum-tight manner, in each case using an annular insulator ring, in particular consisting of ceramic material.

A further embodiment of the invention relates to a hybrid switching device comprising a first and a second electrical terminal, a double-contact switch according to the invention and as disclosed herein, a switching drive comprising an electromechanical drive for moving switching contacts in the direction of the axis of the vacuum switching chambers of the double-contact switch, and a power semiconductor switch comprising a first and a second terminal, wherein the first terminal of the power semiconductor switch and one of the movable electrodes of the double-contact switch is connected to the first electrical terminal of the hybrid switching device, wherein the stationary electrode of the double-contact switch is connected to the second terminal of the power semiconductor switch, wherein the other of the movable electrodes of the double-contact switch is electrically connected to a movable part of the switching drive.

Further advantages and possible applications of the present invention can be derived from the following description in connection with the embodiments shown in the drawings.

In the following description, like, functionally equivalent and functionally related elements may be provided with like reference numerals. In the following, absolute values are given merely by way of example, and should not be construed as limiting the invention.

FIG. 1 is a longitudinal section through a double-contact switch comprising a vacuum switching tube having a rotationally symmetrical, cylindrical configuration comprising two separate switching sub-chambers 1, 3, in particular of similar or identical construction, for mechanical contacts 10, 30 of the switch. The two switching sub-chambers 1, 3 may either be configured as completely separate vacuum chambers or else be partially interconnected in such a way that they have a shared vacuum.

As is shown in FIG. 1, the two switching sub-chambers 1 and 3 are separated in the center of the vacuum switching tube by a partition wall 4, which consists of an electrically conductive material and supports two centrally arranged stationary switching contacts 41, 42 of the mechanical contacts 10 and 30, respectively, the end faces of which each face the interior of one of the switching chambers.

Likewise, the partition wall may be configured in a shape such that it itself is used as a double-contact arrangement. In this case, the contact face of the partition wall may be configured in such a way that it consists of a low-burnup material which simultaneously has good welding resistance. In the event of use in a hybrid contactor having fully arc-free operation, the use of a low-burnup contact material is not absolutely necessary; in this case, a material having good electrical conductivity and sufficient welding resistance is expedient.

The switching contacts are opened and closed by way of axially movable copper electrodes 11, 31, to the inner end faces of which switching contacts 12, 32 of the mechanical contacts 10, 30 of a suitable material, in particular having sufficient welding resistance and good electrical conductivity, are attached. The regions of the two movable electrodes 11, 31 supporting the switching contacts are each sealed off from the outside of the associated switching chamber by means of a flexible metal bellows 13, 33. Each metal bellows 13, 33 is soldered at the end faces, in particular by way of two peripheral, vacuum-tight solder connections, to the associated electrode 11 or 31 and to an associated cover 14 or 34 which closes the associated switching sub-chamber 1, 3.

Opposite the two movable electrodes 11, 31, there is a shared stationary electrode in the form of the aforementioned plate-shaped switching chamber partition wall 4, which either is connected along the entire peripheral face thereof to the wall of the associated switching sub-chamber 1, 3, as a separate part, or preferably itself forms part of the switching chamber wall 43 in the peripheral region.

To guide the load current, the stationary electrode 4 has an appropriately dimensioned, sufficient wall thickness. For electrical insulation from the two movable electrodes 11, 31, the stationary electrode 4 is connected, at the peripheral end faces 43 thereof, to an annular insulator ring 15, 35, for example of ceramic material, in the direction of the associated switching chamber 1, 3 in a vacuum-tight manner.

Figure 2:
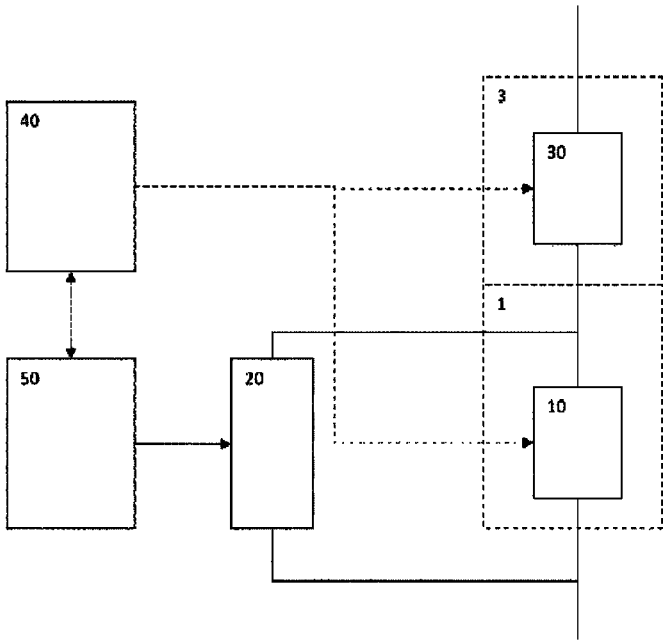
FIG. 2 is the block diagram for an embodiment of a hybrid switching device according to the invention.

In a hybrid switching device, this double-contact switch comprising vacuum switching chambers may as shown in FIG. 2 be incorporated in such a way that one of the two movable electrodes, for example the electrode 11, is rigidly connected to an electrical terminal of the hybrid switching device by way of a planar electrical connection. The stationary electrode 4 of the vacuum switching tube is likewise connected to the hybrid switching device by way of a planar electrical connection in such a way that the mechanical contacts 10 of the first switching sub-chamber 1 which are thus connected are arranged electrically in parallel with a power semiconductor switch 20 of the hybrid switching device. The second movable electrode 31 is connected to the movable part of the electromechanical hybrid switching device drive by way of a further planar electrical connection. The mechanical contacts 30 of the second switching sub-chamber 3 are thus electrically in series with the parallel arrangement consisting of the power semiconductor switch 20 and the mechanical contacts 10 of the first switching sub-chamber 1. In the event of switching actions, the electromechanical drive 40 of the hybrid switching device provides a movement of the movable contacts in the direction of the switching tube axis. The power semiconductor switch 20 is controlled by way of switching electronics 50, which in turn exchange signals with the electromechanical drive 40. The switching electronics 50 are configured in such a way that they control the temporal sequences of connecting through and blocking the power semiconductor switch 20 depending on the switching states of the double-contact switch depending on corresponding signals of the electromechanical drive 40.

Figure 3:
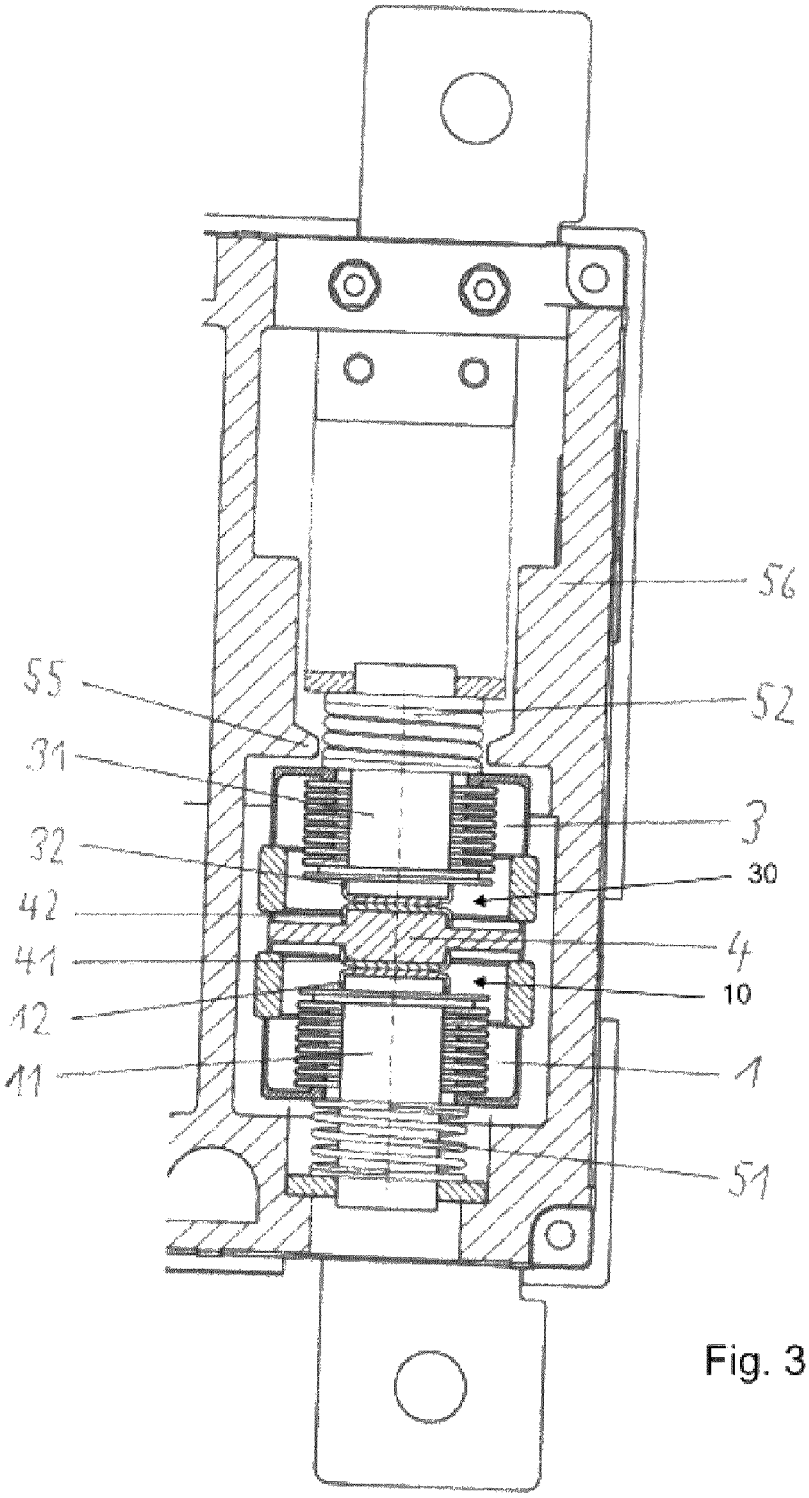
FIG. 3-5 are sectional views of a further embodiment of a double-contact switch comprising vacuum switching chambers according to the invention.
Figure 4:
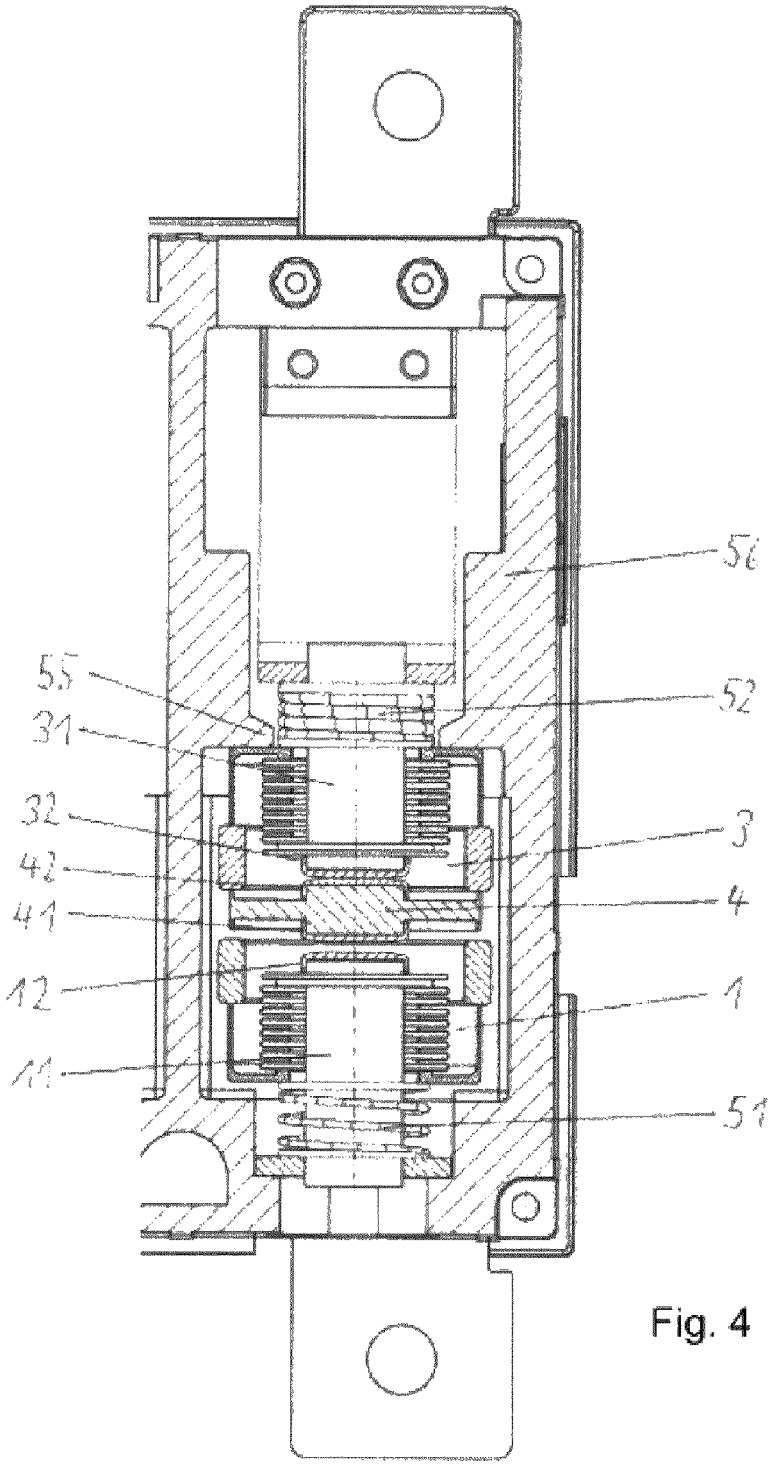
Figure 5:
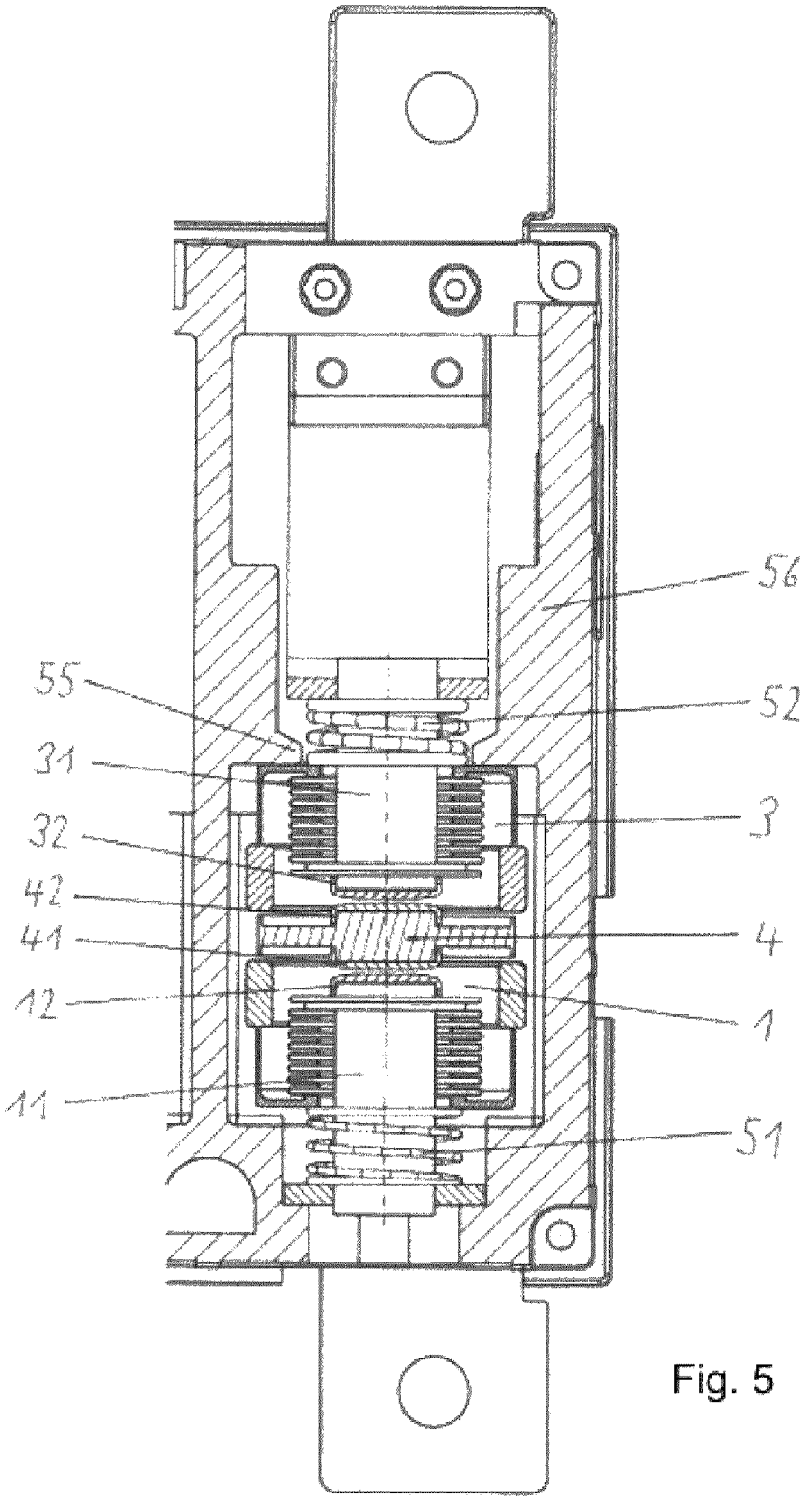

The functionality of the double-contact switch comprising vacuum switching chambers within a hybrid switching device will now be disclosed by way of the different switching states illustrated in FIGS. 3 to 5 of a double-contact switch according to the invention comprising vacuum switching chambers. In this context, reference is also made to the block diagram of FIG. 2, which shows the functionality of the hybrid switching device.

FIG. 3 shows the double-contact switch when a load current is being guided. In this case, the power semiconductor switch 20 is not actuated by the switching electronics 50, and is thus completely blocked, and the entire load current flows exclusively through the fully closed switching contacts 10, 30 of the double-contact switch. In this context, the magnetic drive 40 of the hybrid switching device provides that the movable switching tube contacts 12, 32 are pressed flat against the stationary contacts 41, 42 opposite them in the center of the tube. In this case, the acting contact force F1, F2 for each contact pair 12, 41 and 32, 42 is the sum of the atmospheric pressure acting on the corresponding vacuum chamber 1 or 3 and the additional pressure transmitted to the movable switching contact 12 or 32 by the contact compression spring 51 or 52 connected to the corresponding movable electrodes 11, 31.

FIG. 4 shows the state of the double-contact switch in the first phase of the mechanical switching process when switching off the load current. When the power supply to the magnetic drive coil of the electromechanical drive 40 of the hybrid switching device is switched off, a movement process is introduced in which a force is transmitted to the vacuum switching tube via the movable electrode 31 and leads to the contact pair 12, 41 opening, whilst the contact pair 32, 42 initially still remains closed. This is made possible in that the spring force F1 transmitted by the contact compression spring 51 is less than in the case of the spring force F2 acting on the contact pair 32, 42 from the contact compression spring 52. At the start of the mechanical opening process, the power semiconductor switch 20 connected in parallel with the switching sub-chamber 1 is already fully controlled by the switching electronics 50, to which the switching off of the power supply of the magnetic drive coil has been signaled by the electromechanical drive 40, temporally in advance of the mechanical switching process, in such a way that as soon as the contact pair 12, 41 is opened the entire load current is commuted to the power semiconductor switch 20 and as a result a vacuum arc can no longer form between these mechanical contacts. In this case, the mechanical opening process progresses in such a way that, as a result of the higher spring force F2 of the contact compression spring 52, the entire vacuum switching tube is moved in the direction of the switching sub-chamber 3, whilst the movable electrode 11, which is rigidly connected to the housing of the double-contact switch, remains at rest. Complete opening of the lower contact pair 12, 41 is achieved at the moment when the end face of the switching sub-chamber 3 reaches a mechanical stop 55 which is fixedly connected to the double-contact switch housing 56. Within this time period, the load current commuted to the power semiconductor switch 20 is already brought to zero therein under the control of the switching electronics 50, in such a way that, to achieve reliable galvanic separation in the double-contact switch, the second contact pair 32, 42 of the vacuum switching tube is ultimately also opened without a vacuum arc. In this phase, the power semiconductor switch 20 is already completely blocked again.

The phase of the galvanic separation process is shown in FIG. 5. When the mechanical stop 55 is reached, further movement of the switching tube body relative to the movable electrode 11 of the switching sub-chamber 1 is no longer possible, and so the tensile force, further acting on the movable electrode 31, of the magnetic drive of the electromechanical drive 40 of the hybrid switching device now only makes it possible for the contact pair 32, 42 to open. Complete opening of these break contacts is achieved as soon as the magnetic drive has reached the end position thereof after the switch-off process.

The present invention is suitable in particular for virtually arc-free switching of high direct and low-frequency currents. Switching processes can be carried out virtually without burnup, leading to an increased service life of the switch. The double-contact switch according to the invention can be used in contactors, power switches and motor protection switches, in particular for switching direct currents and low-frequency currents.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B, and C" should be interpreted as one or more of a group of elements consisting of A, B, and C, and should not be interpreted as requiring at least one of each of the listed elements A, B, and C, regardless of whether A, B, and C are related as categories or otherwise. Moreover, the recitation of "A, B, and/or C" or "at least one of A, B, or C" should be interpreted as including any singular entity from the listed elements, e.g., A, any subset from the listed elements, e.g., A and B, or the entire list of elements A, B, and C.

REFERENCE NUMERALS

1 First switching sub-chamber
10 Mechanical contacts (break contacts) of first switching sub-chamber
11 Movable electrode of first switching sub-chamber
12 Movable contact of first switching sub-chamber
13 Bellows of first switching sub-chamber
14 Cover of first switching sub-chamber
15 Insulator ring of first switching sub-chamber
20 Power semiconductor switch
3 Second switching sub-chamber
30 Mechanical contacts (break contacts) of second switching sub-chamber
31 Movable electrode of second switching sub-chamber
32 Movable contact of second switching sub-chamber
33 Bellows of second switching sub-chamber
34 Cover of second switching sub-chamber
35 Insulator ring of second switching sub-chamber
4 Partition wall/stationary electrode
40 Electromechanical drive
41 Fixed contact of first switching sub-chamber
42 Fixed contact of second switching sub-chamber
53 Switching chamber wall of stationary electrode
50 Switching electronics
51 Contact compression spring of first switching sub-chamber
52 Contact compression spring of second switching sub-chamber
55 Mechanical stop
56 Double-contact switch housing

The invention claimed is:

1. A double-contact switch, comprising:

a first and a second tubular vacuum switching chamber, each configured as switching sub-chambers of a switching tube;

an additional electrode, stationary in the switching tube, arranged between the first and second vacuum switching chambers, and including a first fixed contact projecting into the first vacuum switching chamber and a second fixed contact projecting into the second vacuum switching chamber;

a first movable electrode arranged in the first vacuum switching chamber, the first movable electrode being movable in an axial direction in the first vacuum switching chamber, and the first movable electrode including a first region which supports a first electrode contact, the first region being sealed off from outside of the first vacuum switching chamber in a gas-tight manner;

a second movable electrode arranged in the second vacuum switching chamber, the second movable electrode being movable in an axial direction in the second vacuum switching chamber, and the second movable electrode including a second region which supports a second electrode contact, the second region being sealed off from outside of the second vacuum switching chamber in a gas-tight manner;

a first contact compression spring configured to apply a first spring force to the first movable electrode such that the first electrode contact is pressed onto the first fixed contact; and a second contact compression spring configured to apply a second spring force to the second movable electrode such that the second electrode contact is pressed onto the second fixed contact, wherein the first spring force is less than the second spring force;

wherein the switching tube is movably mounted in a housing of the double-contact switch, and wherein the first movable electrode is rigidly connected to the housing of the double-contact switch.

2. The switch of claim 1, wherein the first and the second tubular vacuum switching chambers are switching sub-chambers of the switching tube of cylindrical configuration.

3. The switch of claim 2, wherein the switching tube includes, approximately in a center thereof, a partition wall including a conductive material, configured to separate the first and the second tubular vacuum switching chambers, the partition wall being configured to support the first fixed contact and the second fixed contact on each of two sides thereof such that end faces of the first and second fixed contacts face an interior of an associated vacuum switching chamber and a region of the first movable or second electrode supporting the first or second electrode contact.

4. The switch of claim 2, wherein the switching tube includes, approximately in a center thereof, a partition wall configured to separate the first and the second tubular vacuum switching chambers, the partition wall being configured to act as a double contact arrangement, and wherein a contact face thereof includes an electrically conductive and welding-resistant material.

5. The switch of claim 2, wherein first and second regions are each sealed off in a gas-tight manner using flexible metal bellows.

6. The switch of claim 5, wherein the switching tube includes a cover at each of two ends thereof, and wherein each metal bellows is soldered at end faces thereof to one of the covers and also to one of the first movable and second electrodes, each movable, respectively, in each case via a peripheral vacuum-tight solder connection.

7. The switch of claim 1, wherein the first and second tubular vacuum switching chambers are separated in a gas-tight manner.

8. The switch of claim 1, wherein, for electrical insulation the first movable and second electrodes, the stationary electrode is connected at peripheral end faces thereof to the associated tubular vacuum switching chamber in a vacuum-tight manner, in each case using an annular insulator ring.

9. The switch of claim 8, wherein the annular insulator ring includes a ceramic material.

10. A hybrid switching device, comprising:

a first and a second electrical terminal;

the switch of claim 1;

a switching drive including an electromechanical drive configure to move one or more switching contacts in a direction of an axis of the first and second tubular vacuum switching chambers of the switch; and a power semiconductor switch, connected in parallel with the first fixed contact and the first electrode contact, which open first, and including a first and a second terminal, wherein the first terminal of the power semiconductor switch and one of the first movable and second electrodes of the switch are connected to the first electrical terminal of the hybrid switching device, wherein the additional electrode of the switch is connected to the second terminal of the power semiconductor switch, and wherein the other of the first movable second electrodes of the double-contact switch is electrically connected to a movable part of the switching drive.

11. The switch of claim 1, further comprising: a mechanical stop, fixedly connected to the housing, for an end face of the second vacuum switching chamber.

12. The switch of claim 11, wherein the first spring force transmitted by the first contact compression spring is smaller than the second spring force acting on a second contact pair, including the second electrode contact and the second fixed contact from the second contact compression spring, making it possible, when a movement process is introduced in a first phase of a mechanical switching process when switching off a load current, for a force to be transmitted to the switching tube by way of the second electrode and to lead to an opening of a first contact pair, including the first electrode contact and the first fixed contact, while the second contact pair remains closed until the end face of the second vacuum switching chamber reaches the mechanical stop, and when the mechanical stop is reached, preventing further moving the switching tube relative to the first electrode, and so enabling a tensile force, further acting on the second electrode, an opening of the second contact pair.

13. The switch of claim 1, wherein switching sub-chambers are identical.

14. The switch of claim 1, wherein the first and second tubular vacuum switching chambers are partially interconnected so as to have a shared vacuum.

* * * * *